US006810974B2

(12) United States Patent
Lyon et al.

(10) Patent No.: US 6,810,974 B2
(45) Date of Patent: Nov. 2, 2004

(54) QUICK RELEASE DRILL BIT FOR DOWN-HOLE DRILLS

(75) Inventors: Leland H. Lyon, Roanoke, VA (US); Richard K. Smith, Jr., Otley, IA (US)

(73) Assignee: Atlas Copco AB, Fagersta (SE)

( * ) Notice: Subject to any disclaimer, the term of this patent is extended or adjusted under 35 U.S.C. 154(b) by 39 days.

(21) Appl. No.: 10/380,893

(22) PCT Filed: Sep. 24, 2001

(86) PCT No.: PCT/US01/29765

§ 371 (c)(1),
(2), (4) Date: Mar. 20, 2003

(87) PCT Pub. No.: WO02/25054

PCT Pub. Date: Mar. 28, 2002

(65) Prior Publication Data

US 2004/0011565 A1 Jan. 22, 2004

Related U.S. Application Data

(60) Provisional application No. 60/234,834, filed on Sep. 22, 2000.

(51) Int. Cl.[7] ..... E21B 10/36; B23B 31/117

(52) U.S. Cl. ..... 175/300; 175/414; 279/19.7

(58) Field of Search ..... 173/164, 167, 173/211; 175/299, 300, 304, 414; 279/19.5, 19.6, 19.7; 285/33, 34, 39

(56) References Cited

U.S. PATENT DOCUMENTS 4,953,640 A * 9/1990 Kurt ..... 175/320
5,511,827 A * 4/1996 Steinkamp et al. ..... 285/39
5,522,606 A * 6/1996 Pressley et al. ..... 279/91
5,878,823 A * 3/1999 Henriksson ..... 173/132
5,934,709 A * 8/1999 Morrison ..... 285/39
6,070,678 A * 6/2000 Pascale ..... 175/300

* cited by examiner

*Primary Examiner*—David Bagnell
*Assistant Examiner*—Dan Stephenson
(74) *Attorney, Agent, or Firm*—Michael Best & Friedrich LLP

(57) ABSTRACT

A retainer device (10) is provided for retaining a drill bit (12) within a percussive drill assembly casing (2). The retainer device (10) includes a generally annular body (16) having a central axis and an inner circumferential shoulder portion (18) disposable within the casing (2) such that the body axis (17) is substantially collinear with a casing axis **(2*a*). The shoulder (17) is deflectable between a first position ($P_1$), where the shoulder (18) is contactable with the bit head (14) to retain the bit (12) within the retainer body (16), and a second position ($P_2$). The second position ($P_2$) is spaced radially outwardly from the first position such that the bit head (14) is displaceable through the body (16) in a direction along the casing axis (2*a*). Also, the retainer device (10) includes a spacer (24) that locates the retainer body (16) at a desired axial position within the casing (2) and a centralizer (26) that centers the body (16) about the casing axis (2*a*)**.

19 Claims, 8 Drawing Sheets

QUICK RELEASE DRILL BIT FOR DOWN-HOLE DRILLS

This application claims the benefit of Provisional Application No. 60/234,834 filed Sep. 22, 2000.

BACKGROUND OF THE INVENTION

The present invention relates to rock drilling equipment, and more particularly to drill bits used with down-hole drills.

Referring to FIGS. 1 and 2, percussive down-hole drills 1 are well known and each typically includes a drill casing 2 and a piston (not shown) slidably retained within the casing 2. A chuck 3 is mounted to a lower end 2*c* of the casing 2 and a drill bit 4 is mounted within the casing 2 so as to be slidable through the chuck 3. The drill bit 4 has a lower, working end 4*a* that extends outwardly from the casing 2 so as to be contactable with material of a work site (e.g., where a hole is being drilled). The piston (not shown) impacts the bit 4 such that the bit 4 transfers the impact force to the material (e.g., rocks, earth, etc.) to cause the material to fracture apart into removable pieces.

One type of percussive drilling device called a "cluster drill" 5 is formed of a plurality of separate down-hole drills 1 mounted within a large cylindrical case 6. As a cluster drill typically includes several individual drills 1, and thus several drill bits 4, a substantial amount of time is required to change all of the bits 4, which becomes necessary when the bit working ends 4*a* become worn down through use. The required maintenance is increased by the relatively difficult process of removing and installing each bit 4 mounted within the casing by known retainer devices 7, which are typically two half-ring segments 7*a*, 7*b*, as discussed below. For one type of known cluster drill 5 having fifteen (15) separate drills 1, the average time to change the bit 4 of each drill 1 is approximately 30–45 minutes, such that the time to remove and replace all of the bits 4 is estimated at one complete ten-hour day using a three person crew.

Referring particularly to FIG. 2, a typical process for removing a bit 4 from a down-hole drill 1 proceeds as follows. First, a backhead nut 8 is un-threaded from the upper, backhead portion (not shown) of the individual drill 1 (FIG. 2*a*), which thereby releases the individual drill 1 from the cluster case 6 (FIG. 2B). Next, the released drill 1 is placed in a threaded "joint breaking" device (not shown) which is used to unthread the threaded joint between the casing 2 of the particular drill 1 and the chuck 3 mounted to the lower end 2*b* of the casing 2 (FIG. 2C). Due to the high torque required both to loosen the backhead nut 8 and to "break" the threaded chuck-casing joint, relatively heavy and cumbersome equipment (not shown) is required to perform these functions.

As shown in FIG. 2D, the chuck 3 is then un-threaded from the drill casing 2, releasing the chuck 3, the drill bit 4 and the retaining ring segments 7*a*, 7*b* from the casing 2. The ring segments 7*a*, 7*b* are then removed from the chuck-and-bit assembly (FIG. 2E) and the chuck 3 is slided off of the drill bit 4 (FIG. 2F). After the bit 4 is replaced by a new bit 4, the above-described steps are executed in reverse to install the bit 4 within the chuck 3, the chuck 3 and bit 4 assembly within the individual drill casing 2 and finally the drill 1 into the cluster casing 6.

Thus, it would be desirable to have a bit retaining device that reduces the amount of time and effort to install and remove the bits 4 of down-hole drills 1.

SUMMARY OF THE INVENTION

In one aspect, the present invention is a device for retaining a drill bit connected with a casing of a percussive drill assembly. The casing has a central axis and the bit has a generally cylindrical head. The retainer device basically comprises a generally annular body having a central axis and an inner circumferential shoulder portion projecting generally toward the axis. The body is disposeable within the casing such that the body axis is substantially collinear with the casing axis. The shoulder is deflectable between a first position, where the shoulder is contactable with the bit head to retain the bit disposed at least partially within the retainer body, and a second position. The second position is spaced radially outwardly from the first position such that the bit head is displaceable through the body in a direction generally along the casing axis.

In another aspect, the present invention is a drill assembly comprising a casing having a hollow interior and a central axis and a drill bit having a generally cylindrical head. A generally annular retainer is disposed within the casing interior and has an inner circumferential shoulder projecting generally toward the casing axis. The shoulder is deflectable between a first position, where the shoulder is contactable with the bit head to retain the bit disposed at least partially within the retainer, and a second position. The second position is spaced radially outwardly from the first position such that the bit head is displaceable through the retainer in a direction generally along the casing axis.

BRIEF DESCRIPTION OF THE SEVERAL VIEWS OF THE DRAWINGS

The foregoing summary, as well as the detailed description of the preferred embodiments of the invention, will be better understood when read in conjunction with the appended drawings. For the purpose of illustrating the invention, there is shown in the drawings, which are diagrammatic, embodiments that are presently preferred. It should be understood, however, that the invention is not limited to the precise arrangements and instrumentalities shown. In the drawings:

FIG. 2, are several perspective views depicting the process of removing a drill bit retained within a drill casing by a known retainer device;

DETAILED DESCRIPTION OF THE INVENTION

Figure 1:
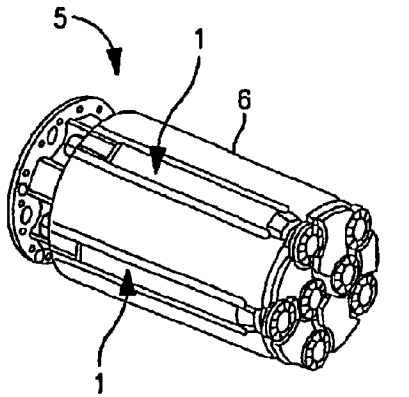
FIG. 1 is a perspective view of a typical percussive cluster drill assembly.
Figure 2A:
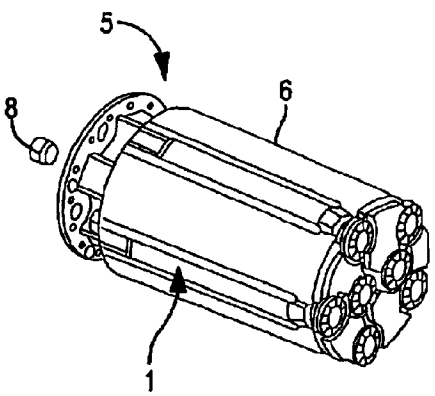
FIGS. 2A–2F, collectively
Figure 2B:
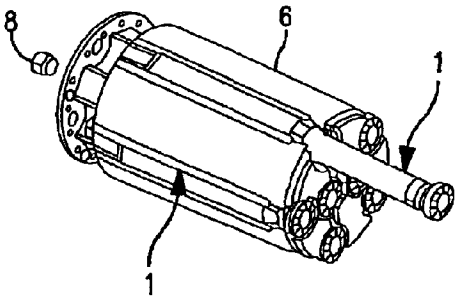
Figure 2C:
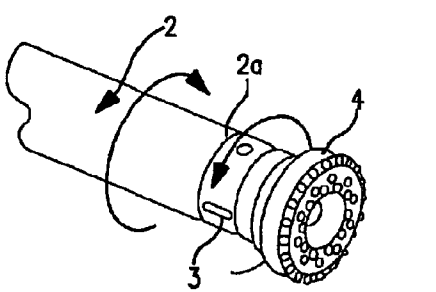
Figure 2D:
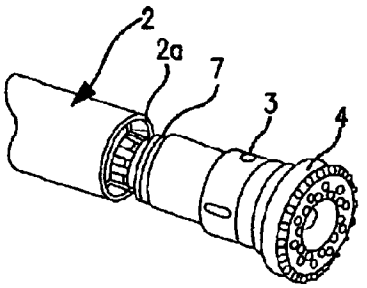
Figure 2E:
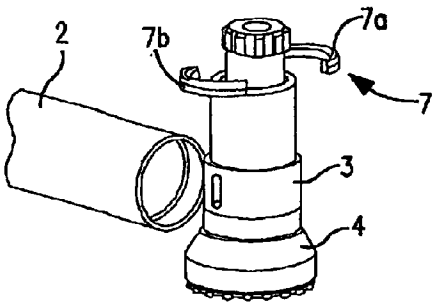
Figure 2F:
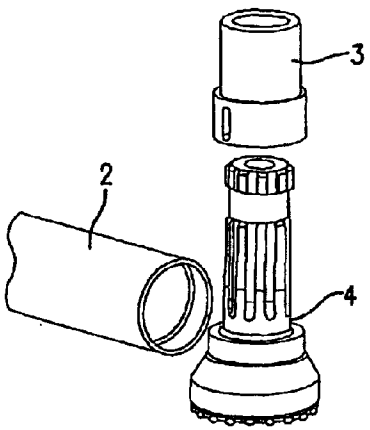
Figure 3:
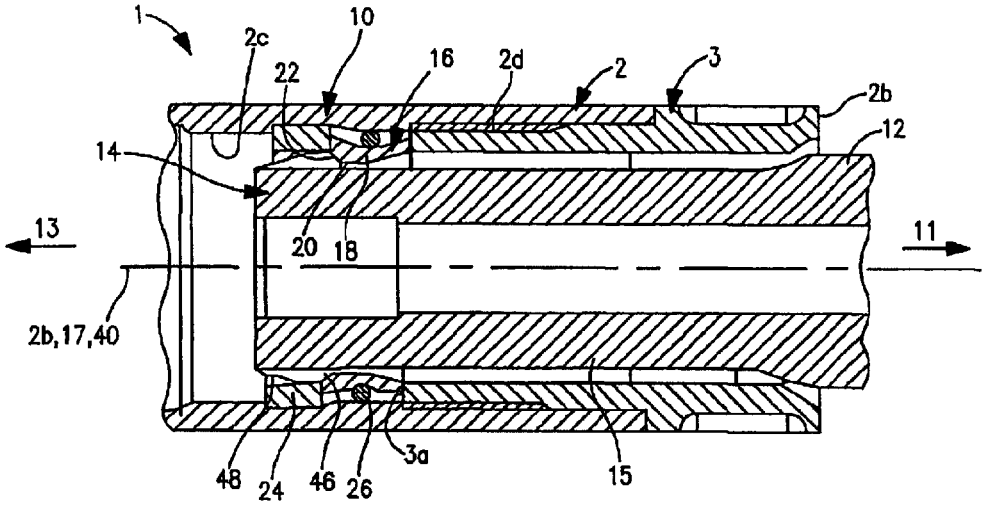
FIG. 3 is a broken-away, side cross-sectional view of a percussive drill assembly having a first preferred construction of a retainer device in accordance with the present invention.

Certain terminology is used in the following description for convenience only and is not limiting. The words "right", left", "lower", "upper", "upward", "down" and "downward" designate directions in the drawings to which reference is made. The words "inner", "inward" and "outer", "outward" refer to directions toward and away from, respectively, the axis of a drill casing or of a retainer device or the geometric center of the retainer device, the drill assembly or a specific portion of either, the particular meaning being readily apparent from the context of the description. The terms "radial", "radially" and "radially-extending" refer to directions generally perpendicular to a designated axis, and refer both to elements that are either partially or completely oriented in radial direction. The terminology includes the words specifically mentioned above, derivatives thereof, and words or similar import.

Referring now to the drawings in detail, where like numbers are used to indicate like elements throughout, there is shown in FIGS. 3–13 a retainer device 10 in accordance with the present invention for retaining a drill bit 12 within the casing 2 of a percussive drill assembly 1. The casing 2 has a generally hollow interior and a central axis 2*a* and the bit 12 has a generally cylindrical head 14. The retainer device 10 basically comprises a generally annular retainer body 16 having a central axis 17 and a shoulder portion or shoulder 18 that projects radially inwardly from a remainder of the body 16 and generally toward the axis 17.

Figure 6:
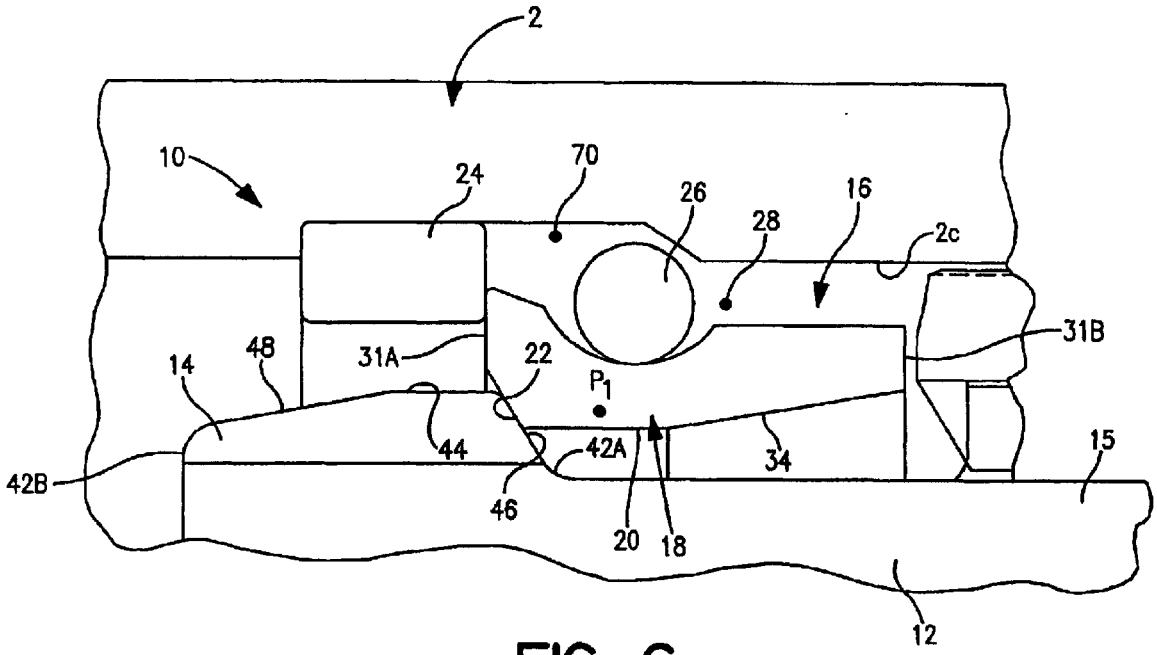
FIG. 6 is an enlarged broken-away side cross-sectional view the drill assembly of FIG. 5, showing a bit head contacting a retainer body with a retainer shoulder in a first position.
Figure 7:
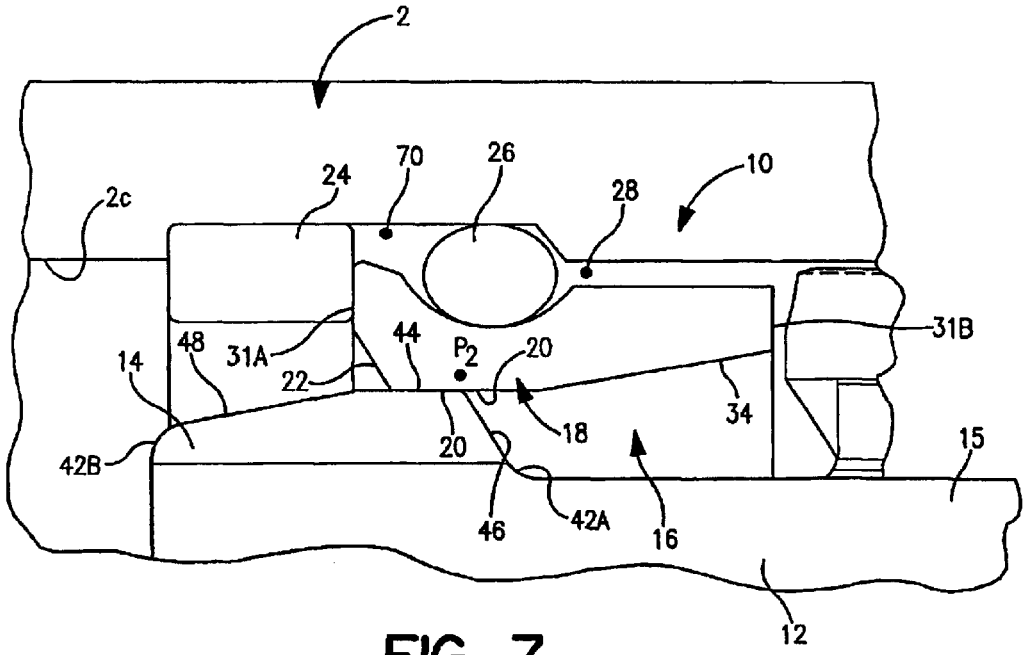
FIG. 7 is another view of the drill assembly of FIG. 6, showing the bit head displacing through the retainer body with the shoulder in a second position.

The body 16 is disposeable within the casing 2 such that the body axis 17 is substantially collinear with the casing axis 2*a*. The shoulder 18 is movable or deflectable between a first position $P_1$ (FIG. 6), where the shoulder 18 is contactable with the bit head 14 to retain the bit 12 disposed at least partially within the body 16 (and thus also within the casing 2), and a second position $P_2$ (FIG. 7). The second position $P_2$ is spaced radially outwardly from the first position $P_1$ such that the bit head 14 is displaceable through the retainer body 16 in a direction 11 or 13 generally along the casing axis 2*a*, as discussed below.

Further, the retainer device 10 also preferably includes a centralizer 26 configured to generally center the retainer body 16 within the casing 2 about the axis 2*a* and a spacer 24 configured to retain the body 16 within the casing 2 at a desired position along the casing axis 2*a*. Each of the above-discussed basic elements of the retainer device 10 is described in greater detail below.

Figure 4:
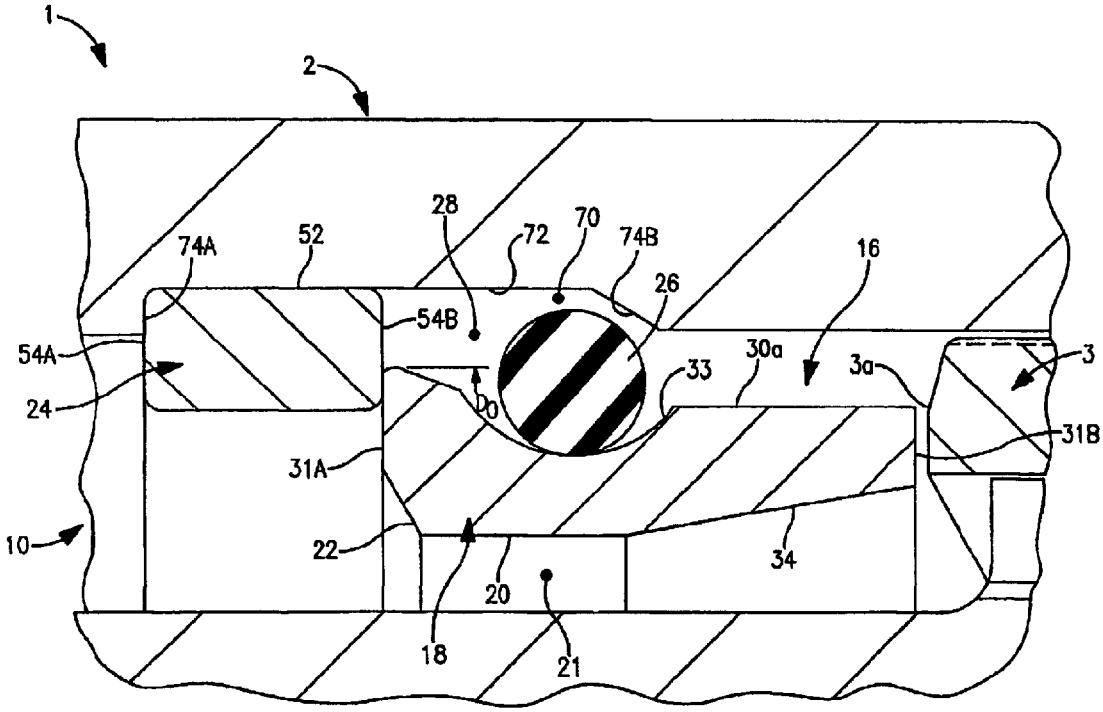
FIG. 4 is a greatly enlarged, broken-away view of a portion of the drill assembly depicted in FIG. 3.

Referring generally to FIGS. 3–9, the retainer device 10 is preferably used with a drill casing 2 having an inner circumferential surface 2*c* and an annular recess 70 extending circumferentially into the casing 2 from the inner surface 2*c*. As best shown in FIG. 4, the recess 70 has an inner circumferential surface 72 and a pair of opposing radial surfaces 74A, 74B and is configured to accept the spacer member 24 so as to locate the retainer device 10 at a desired position along the casing axis 2*a*, as discussed in further detail below.

Referring now to FIGS. 3–10, the retainer device 10 is also preferably used with a drill bit 12 having a central axis 40 that is collinear with the casing axis 2*a* when the bit 12 is connected with the drill assembly 1. The bit 12 is movable or displaceable along the casing axis 2*a* in a first, outward direction 11 (i.e., away from the center of the drill 1) so as to extend further outside of the casing 2 and alternately in a second, inward axial direction 13 along the axis 2*a* so as to be disposed more fully within the casing 2.

Figure 10:
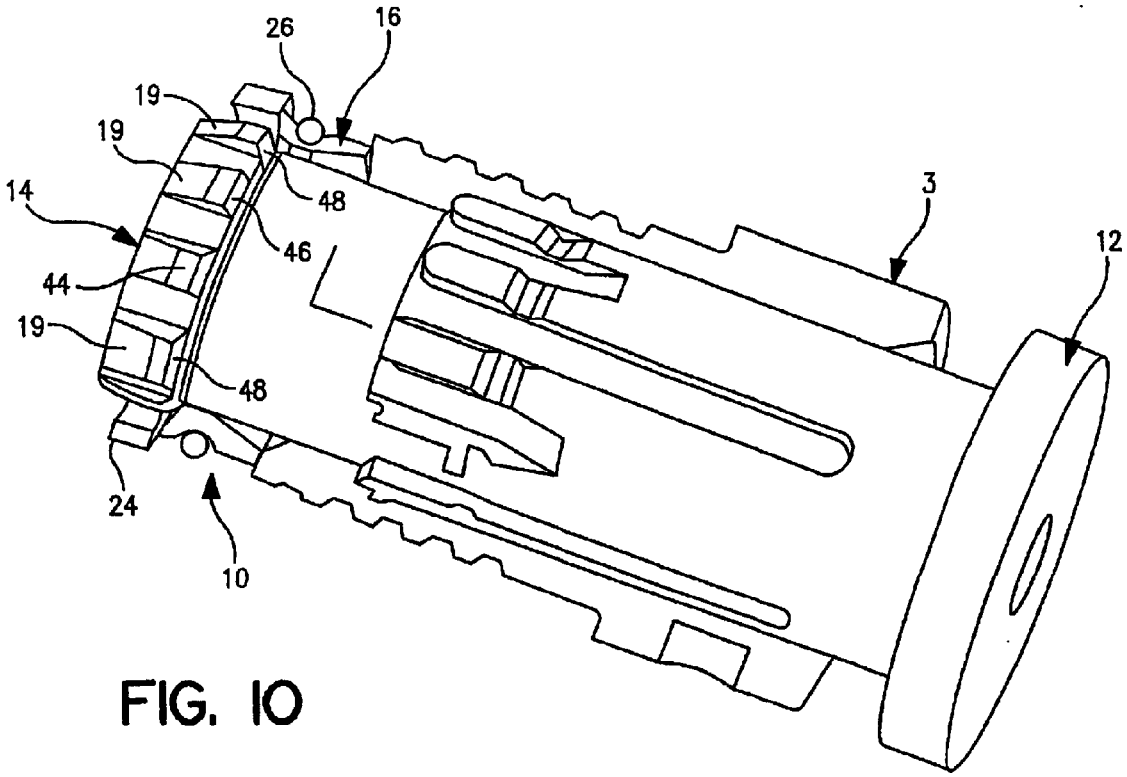
FIG. 10 is a perspective view of the retainer device and the drill chuck, each shown partially broken-away, disposed about the drill bit.

Referring particularly to FIGS. 5–7 and 10, the bit head 14 is preferably constructed generally as follows. As best shown in FIG. 10, the head 14 is preferably provided by a plurality of segments 19 projecting radially outwardly from a bit shank 15 and spaced circumferentially about shank 15, but may alternatively be provided by a single annular projection or shoulder (not depicted). However, for purposes of clarity of description, the bit head 14 is described in detail as a single element or component, although each separate segment 19 of the head 14 has the surfaces, ends and other features described below for the bit head 14.

Figure 5:
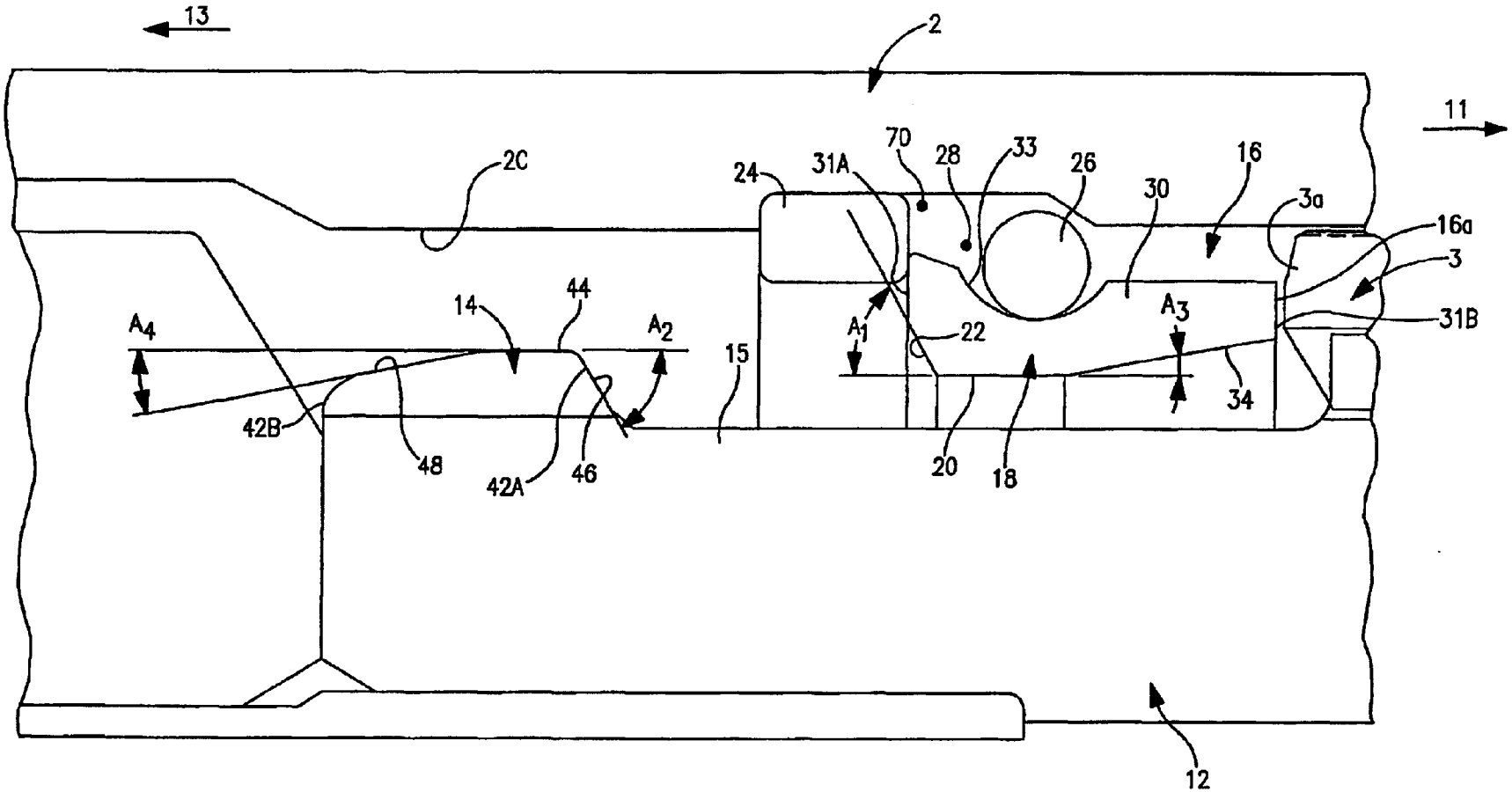
FIG. 5 is an enlarged, broken-away side cross-sectional view of a portion of the drill assembly of FIG. 3, showing certain structural features of one preferred construction of a drill bit and the retainer device.

The bit head 14 preferably has opposing axial ends 42A, 42B and a circumferentially-extending, radially outermost surface 44 disposed between the ends 42A, 42B. The outermost surface 44 is sized such that the head 14 has an outside diameter $D_H$ (FIG. 9) larger than an inside diameter of the retainer body 16, as discussed below. As best shown in FIG. 5, the head 14 preferably includes an outer circumferential release surface 46 extending generally radially between the first radial end 42A and the outermost surface 44. More specifically, the release surface 46 is angled generally radially outwardly so as to extend from a more proximal radial position (i.e., with respect to the bit axis 40) at the first radial end 42A to a more distal radial position at the outermost surface 44. As such, when the bit 12 is disposed in the casing 2, the release surface 46 faces generally away from the casing axis 2*a* and generally toward the first axial direction 11. Further, the release surface 46 defines an acute angle $A_2$ (FIG. 5) with respect to the casing axis 2*a*, as discussed in further detail below.

Furthermore, the bit head 14 also preferably includes an outer circumferential insertion surface 48 that extends generally radially between the second radial end 42B and the outermost surface 44, as best shown in FIG. 5. More specifically, the insertion surface 48 is angled generally radially outwardly so as to extend from a more proximal radial position (i.e., with respect to the bit axis 40) at the second radial end 42B to a more distal radial position at the outermost surface 44. As such, when the bit 12 is disposed in the casing 2, the insertion surface 48 faces generally away from the casing axis 2*a* and generally toward the second axial direction 13. Further, the insertion surface 48 defines an acute angle $A_4$ (FIG. 5) with respect to the casing axis 2*a*, as discussed in further detail below. The purpose/function of the release surface 46 and the insertion surface 48 are each discussed in detail below.

Figure 11:
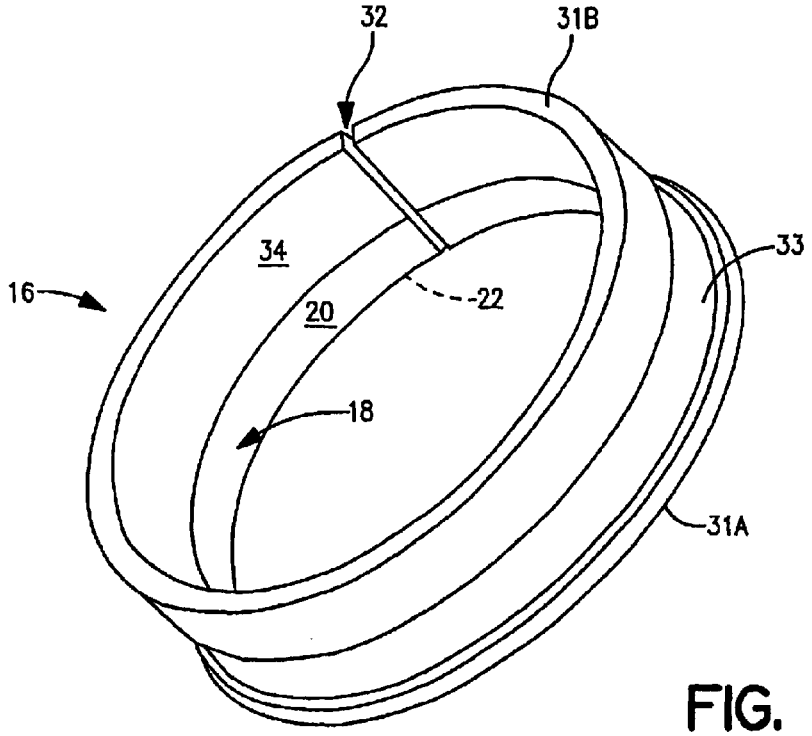
FIG. 11 is a perspective view of a retainer body.

Referring again to FIGS. 3–11, the annular retainer body 16 is preferably formed as generally circular ring 30 substantially circumscribing the body axis 17. The ring 30 has complex-shaped axial cross sections, as best shown in FIG. 4, and an axially-extending split or slot 32 (FIG. 11). The slot 32 enables the entire body 16, and thereby also the shoulder portion 18 of the body 16, to radially deflect or expand in a manner generally similar to the expansion and contraction of a "snap ring", as discussed above and in further detail below. Alternatively, the retainer body 16 may be formed without a slot and configured such that the shoulder portion 18 deflects independently of the remainder of the body 16. For example, the retainer 16 may be provided with a shoulder 18 that is configured to deflect or bend in the manner of a cantilever beam (not shown). In other words, the shoulder 18 may be configured to bend or pivot with respect to the remainder of the body 16 to move between a first position $P_1$ where the shoulder 18 projects generally toward the casing axis 2*a* and a second position $P_2$ where the shoulder 18 extends generally along the axis 2*a* (and is thus also disposed radially outward from the first position $P_1$).

Further, as discussed below, the retainer body 16 is preferably formed of either an elastic material or an elastomeric material such that material forces are generated within the body 16 when the shoulder 18 is deflected (i.e., radially outwardly). These elastic forces function to bias the shoulder 18 generally back toward the first shoulder position $P_1$ (FIG. 6) from the second position $P_2$ (FIG. 7), so that retainer device 10 functions as described above and in further detail below. Alternatively, the retainer body 16 may be provided with separate or additional components, such as spring-like members (none shown), configured to bias the shoulder 18 back to the first position $P_1$.

Further, as best shown in FIG. 4, the body ring 30 further includes a semi-circular groove 33 extending into the outer circumferential surface 30*a* of the ring 30, the centralizer 26 being preferably disposed partially within the groove 33 to retain the centralizer 26 disposed about the retainer body 16, as discussed below. Further, the ring 30 has opposing, inner and outer axial ends 31A, 31B, respectively, with radial surfaces facing in opposing axial directions.

Still referring to FIGS. 3–11, the retainer shoulder 18 is preferably provided by an integral portion of the body ring 30 that projects radially-inwardly toward the body axis 17 and extends circumferentially so as to substantially circumscribe the body axis 17. Alternatively, the shoulder 18 may be provided by two or more arcuate segments (not depicted) spaced circumferentially about the inner circumferential surface of the body ring 30. As yet another alternative, the shoulder 18 may be provided by one or more separate, appropriately formed members (none shown) attached to or connected with the body ring 30, by any appropriate means, so as to project radially inwardly from the ring 30.

Figure 9:
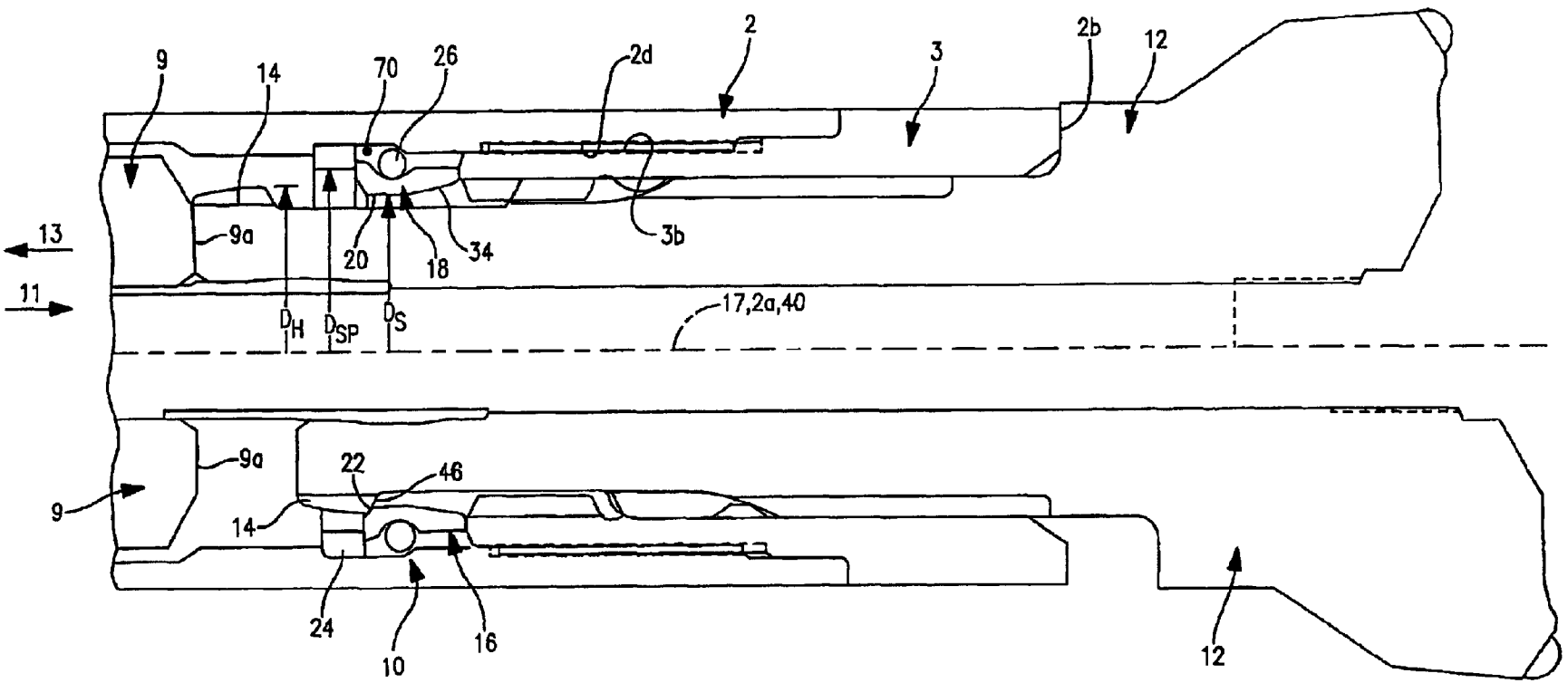
FIG. 9 is another side cross-sectional view of the drill assembly depicting the drill bit in an operational position in the upper half of the drawing figure and the drill bit being retained by the retainer device in the lower half of the drawing figure.

The shoulder 18 has a circumferentially-extending, radially innermost surface 20 bounding a central bore 21 through the body 16. The bore 21 has an inside diameter $D_s$ that is sized substantially smaller than an outside diameter $D_H$ of the bit head 14, as indicated in FIG. 9. As such, displacement of the bit head 14 within the casing 2 in the first axial direction 11 is generally limited by the retainer body 16, specifically the shoulder 18, as discussed in greater detail below.

Referring now to FIGS. 4–7, the shoulder 18 preferably further includes an inner circumferential stop surface 22 extending generally radially between the first radial end 31A and the innermost surface 20. More specifically, the stop surface 22 is angled generally radially inwardly so as to extend from a more distal radial position (i.e., with respect to the body axis 17) at the body first radial end 31A to a more proximal radial position at the shoulder innermost surface 20. As such, the stop surface 22 faces generally toward the body axis 17 and generally away from the first axial direction 11.

Referring particularly to FIG. 5, the stop surface 22 defines an acute angle Al with respect to the body axis 17 that is substantially equal to the acute angle $A_2$ defined by the release surface 46, such that each has the same, first angular value. Preferably, the first angular value of the two angles $A_1$, $A_2$ is at least 45°, and most preferably about 60° (measured as indicated), so that the stop surface 22 (and thus also the release surface 46) is primarily or substantially radially extending. Such an orientation enables the stop surface 22 to effectively limit axial movement of the bit 12, as discussed below, but the first angular value of the angles $A_1$, $A_2$ may alternatively be any other appropriate value as desired.

Although having the same value, the angles $A_1$, $A_2$ are oppositely oriented such that release surface 46 is juxtaposable against the stop surface 22, with the release surface 46 being spaced slightly radially inward of the stop surface 22. The relative configuration of the two surfaces 22, 46 enables the release surface 46 to be slidable against the stop surface 22 in the manner of a wedge to deflect the shoulder 18 radially outwardly. More specifically, with the mating surfaces 22 and 46 constructed to have an angular value of 60°, the release surface 46 interacts with the shoulder 18 in the manner of a wedge having a mechanical advantage along the axis 2*a* of 0.58 (i.e., disregarding friction), as discussed in further detail below.

With the above-described configuration, the bit 12 is generally retained within the casing 2, and specifically disposed at least partially within the retainer body 16, by the interaction between the stop surface 22 and the release surface 46. More specifically, as the bit 12 reciprocates within the casing 2 during normal operation of the drill assembly 1, the bit 12 displaces in the first axial direction 11 until the head release surface 46 comes into contact with the retainer stop surface 22, as best shown in FIG. 6. Generally, the bit head 14 does not impact the retainer body 16 with sufficient force to cause the release surface 46 to wedge open the retainer shoulder 18. As such, contact between the stop surface 22 and the release surface 46 generally limits the extent of bit displacement in the first axial direction 11, as depicted in FIGS. 6 and 9.

However, when an extraction force of at least a first magnitude and directed generally in the first axial direction 11 is applied to the bit 12, the release surface 46 slides against the stop surface 22 and deflects the shoulder 18 (and thus the entire body 16) radially outwardly toward the second shoulder position $P_2$ (see FIG. 7). In other words, the sliding release surface 46 pushes radially outwardly against the stop surface 22 to wedge open the retainer body 16, allowing the bit head 14 displace through the retainer body 16 in the first axial direction 11. When the bit head 14 has displaced completely through the retainer body 16, such that the bit 12 is disengaged from the retainer device 10, the shoulder 18 deflects back to the first position $P_1$ by material forces in the retainer body 16, as discussed above.

Referring again to FIGS. 4–7, the shoulder 18 preferably further includes an inner circumferential lead-in surface 34 extending generally radially between the body second radial end 31B and the shoulder innermost surface 20. More specifically, the lead-in surface 22 is angled generally radially inwardly so as to extend from a more distal radial position (i.e., with respect to the body axis 17) at the second radial end 31A of the body 30 to a more proximal radial position at the shoulder innermost surface 20. As such, the lead-in surface 34 faces generally toward the body axis 17 and generally away from the second axial direction 11. Thus, the two angled surfaces of the shoulder 18, the stop surface 22 and the lead-in surface 34, face in generally opposing directions.

Further, the lead-in surface 34 defines an acute angle $A_3$ (FIG. 5) with respect to the body axis 17 that is substantially equal to the acute angle $A_4$ defined by the insertion surface 48, such that each has the same, second angular value. Preferably, the angular value of the two angles $A_3$, $A_4$ is about 10° (measured as indicated), but may alternatively have any other appropriate value as desired.

Although having the same value, the angles $A_3$, $A_4$ are oppositely oriented such that the insertion surface 48 is juxtaposable against the lead-in surface 34, with the insertion surface 48 being spaced slightly radially inwardly of the lead-in surface 34. The relative configuration of the two surfaces 34, 48 enables the insertion surface 48 to be slidable against the lead-in surface 34 in the manner of a wedge to deflect the shoulder 18 radially outwardly, as discussed in detail below. More specifically, with the mating surfaces 34 and 48 constructed to have an angular value of 10°, the insertion surface 48 interacts with the shoulder 18 in the manner of a wedge having a mechanical advantage along the axis 2*a* of about 5.67 (i.e., disregarding friction), as discussed below.

With the above-described configuration, insertion of the bit 12 into the retainer device 10 is enabled by the interaction between the lead-in surface 34 and the insertion surface 48, in the following manner. When the bit 12 is being installed in the casing 2, the bit 12 is pushed along the casing axis 2*a* until the second radial end 42B of the bit head 14 contacts the retainer body 16, and specifically the head insertion surface 48 contacts the shoulder lead-in surface 34 (see upper half of FIG. 8). Then, by applying to the bit 12 an insertion force of at least a second magnitude and directed generally in the second axial direction 13, the insertion surface 48 slides against the lead-in surface 34 and deflects the shoulder 18 (and thus the entire body 16) radially outwardly toward the second shoulder position $P_2$ (see lower half of FIG. 8 and FIG. 7).

In other words, the sliding insertion surface 48 pushes radially outwardly against the lead-in surface 34 to wedge open the retainer body 16, allowing the bit head 14 to displace through the retainer body 16 in the second axial direction 13. When the bit head 14 has displaced completely through the retainer body 16, such that the bit 12 is partially disposed within the retainer bore 21, the shoulder 18 deflects back to the first position $P_1$ by material forces in the retainer body 16, as discussed above. Thereafter, the bit 12 is releasably retained within the retainer body 16 by the shoulder 18, as described above.

Comparing the configuration of the two pairs of mating angled surfaces, the first pair, stop surface 22 and release surface 46, has a first preferred angular value of about 60°, resulting in a mechanical advantage of about 0.58. The second pair, lead-in surface 34 and insertion surface 48, has a second preferred angular value of about 10°, resulting in a mechanical advantage of about 5.67. As is readily apparent, the geometric difference between the two pairs of mating surfaces, as indicated by the difference in the angular values, results in the first pair of surfaces 22 and 46 having a mechanical advantage that is 9.8 times less than the advantage of the second pair of surfaces 34 and 48.

With this significant difference in mechanical advantage, the magnitude of the extraction force is substantially greater than the magnitude of the insertion force. In other words, it requires a much greater force to remove the bit 12 from the retainer device 10 than to install the bit 12 within the retainer device 10. The significant difference between insertion and removal forces is an important advantage of the retainer device 10, as discussed in further detail below.

Preferably, the retainer body 16 is machined or cast from a metallic material, most preferably a hardened alloy steel. Alternatively, the retainer body 16 may be constructed of any other appropriate metallic material, such as low carbon steel or aluminum, or may be formed of a polymer, such as for example polyurethane. In any case, the specific material selected for the retainer body 16 should have sufficient elastic or elastomeric properties to bias the shoulder 18 back from a deflected position, as discussed above.

Referring now to FIGS. 3–10, in a first, preferred construction of the retainer device 10, the retainer body 16, and the spacer 24 and the centralizer 26 are provided as three separate components. The spacer 24 is preferably generally annular and functions to retain the annular retainer body 16 at a desired position within the casing 2, as discussed above. Most preferably, the spacer 24 is constructed as a substantially circular ring 50 having generally rectangular axial cross-sections (i.e., sections taken along the axis 17).

Referring particularly to FIG. 4, the spacer 24 has an outer circumferential surface 52 and two opposing axial ends 54A, 54B. The inner circumferential surface 52 is sized to be disposed against the inner surface 72 of the casing recess 70 such that the spacer 24 is incapable of any substantial radial movement after installation within the recess 70. Furthermore, the spacer 24 includes a split or slot (not depicted) such that the spacer 24 is radially deflectable to facilitate both insertion of the spacer 24 into the recess 70 and removal therefrom.

As shown in FIG. 4, the spacer 24 is configured to fit within the casing recess 70 such that the inner or first axial end 54A is disposed against the proximal radial surface 74A of the recess 70 and the outer or second axial end 54B is disposeable against a proximal axial end 31A of the retainer body 16 to axially retain the body 16, as discussed in further detail below. Further, the spacer 24 has an inside diameter $D_{sp}$ (FIG. 9) that is greater than the outside diameter $D_H$ of the bit head 14, such that entire drill bit 12 is able to pass through the center of the spacer 24, preferably without making contact therewith.

Preferably, the spacer 24 is constructed of a metallic material, most preferably a hardened alloy steel, although alternatively, another appropriate metallic material may be used (e.g., low carbon steel, aluminum) or even a durable polymeric material such as, for example, polyurethane.

Still referring to FIGS. 3–10, the centralizer 26 functions to generally center the annular retainer body 16 within the drill casing 2 such that the body axis 17 is substantially collinear with the casing axis 2*a*, for reasons discussed below.

The centralizer 26 is preferably formed as a generally annular ring or tube configured to be disposed about the outer circumferential surface 30*a* of the retainer body 16, and most preferably to be disposed within the body outer groove 33. Further, the centralizer 26 is sized to be disposed at least partially within the casing recess 70 so that the centralizer 26 generally centers the retainer body 16 within the casing 2 with the body axis 17 being substantially collinear with the casing axis 2*a*.

Centering the retainer body 16 both facilitates insertion of the bit head 14 (and thus the entire bit 12) and prevents undesired contact between the retainer body 16 and the shank 15 of the bit 12. More specifically, for the preferred construction of the retainer device 10, the centralizer 26 is necessitated due to the fact that the maximum outside diameter $D_O$ of the retainer body 16 is substantially less than the inside diameters (not indicated) of recess 70 and the adjacent casing section(s) surrounding the body 16, such that a significant gap 28 surrounds the retainer body 16.

Although a certain amount of gap space is required to provide space for deflection of the retainer body 16 during installation and removal of the bit 12, as described in further detail below, the centralizer 26 occupies or fills a portion of the gap 28 to limit the radial movement of the retainer body 16 within the casing 12. By limiting radial movement of the retainer body 16, contact between the retainer inner circumferential surface 20 and the shank outer circumferential surface 15*a* is prevented as such contact will cause the bit shank 15 (and thus the entire bit 12) to wear prematurely, thus shortening bit life. Furthermore, the centralizer 26 is preferably at l compressible material such that the Preferably, the centralizer 26 is formed of a compressible material, preferably an elastomer, so that when the retainer body 16 deflects radially outwardly, the centralizer 26 is able to become compressed between the recess inner surface 72 and the retainer body groove 33, rather than inhibiting deflection of the body 16. Most preferably, the centralizer 26 is formed of a tube of nitrile that is bended into a generally circular shape and joined end-to-end and having generally circular axial cross-sections. Alternatively, the centralizer 26 may be provided by a commercially available "O"-ring with circular axial cross sections. As further alternatives, the centralizer 26 may be provided by two or more arcuate sections and/or may have any other appropriate axial cross-sectional shape (e.g., elliptical, rectangular, polygonal, etc.).

Although the retainer device 10 preferably includes a centralizer 26, the retainer device 10 may alternatively be constructed with a retainer body 16 sized radially larger than as depicted in the drawings, so as to eliminate the need for the centralizer 26. With such an alternative retainer body 16, the body 16 must not be sized too large so as to fill the entire gap 28, but rather must provide a sufficient gap 28 to enable body radial deflection, as discussed above and in further detail below.

Figure 12:
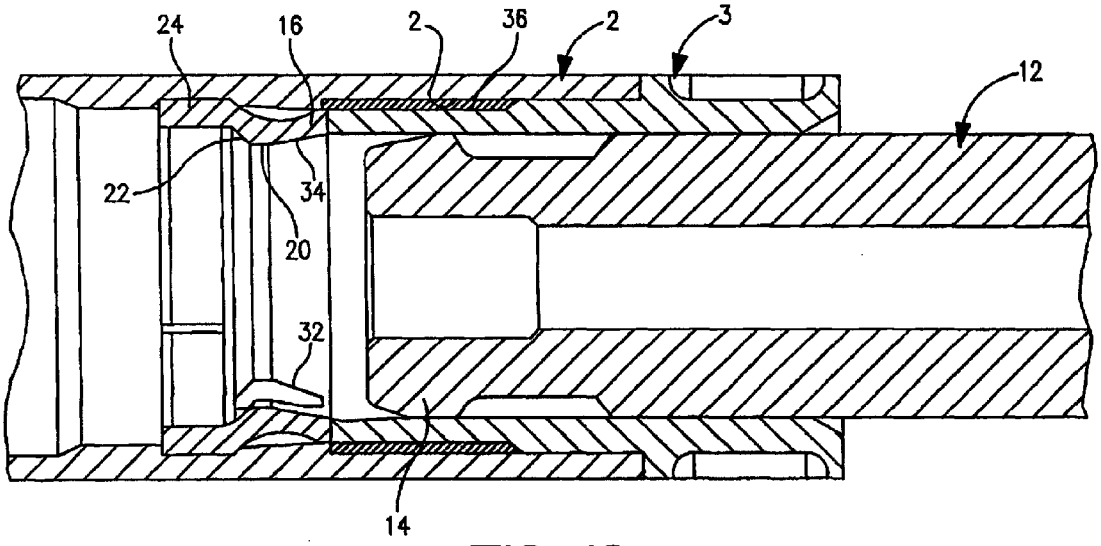
FIG. 12 is a broken-away, side cross-sectional view of a percussive drill assembly having a second preferred construction of the retainer device, depicting the bit in a position non-engaged with the retainer device.
Figure 13:
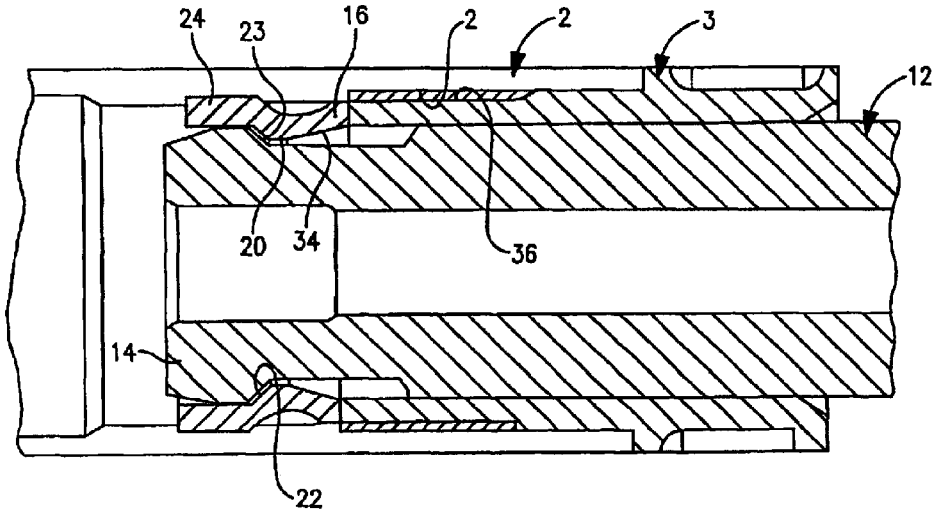
FIG. 13 is another view of the percussive drill assembly of FIG. 12, showing the bit engaged with the retainer device.

Referring now to FIGS. 12 and 13, a second preferred construction of the retainer device 10 is generally similar to the first construction as described above, except for the following differences. The retainer body 16 and the spacer 24 are integrally formed together and the device 10 does not include a centralizer as the integrally connected spacer 24 also functions to centralize the retainer body 16 within the casing 2. Thus, the second construction of the retainer device 10 is of one-piece construction and the entire device 10 is installed into and removed from a drill casing 2 as a single unit.

Further, to provide the required amount of deflection or expansion of the portion providing the retainer body 16, the integral retainer device 10 is preferably formed of polyurethane, but may be formed of any other appropriate material, such as for example, another polymeric material or a metallic material such as low carbon steel. Otherwise, the second preferred construction is formed and functions substantially identically as the first preferred construction and provides the same advantages discussed above.

Figure 8:
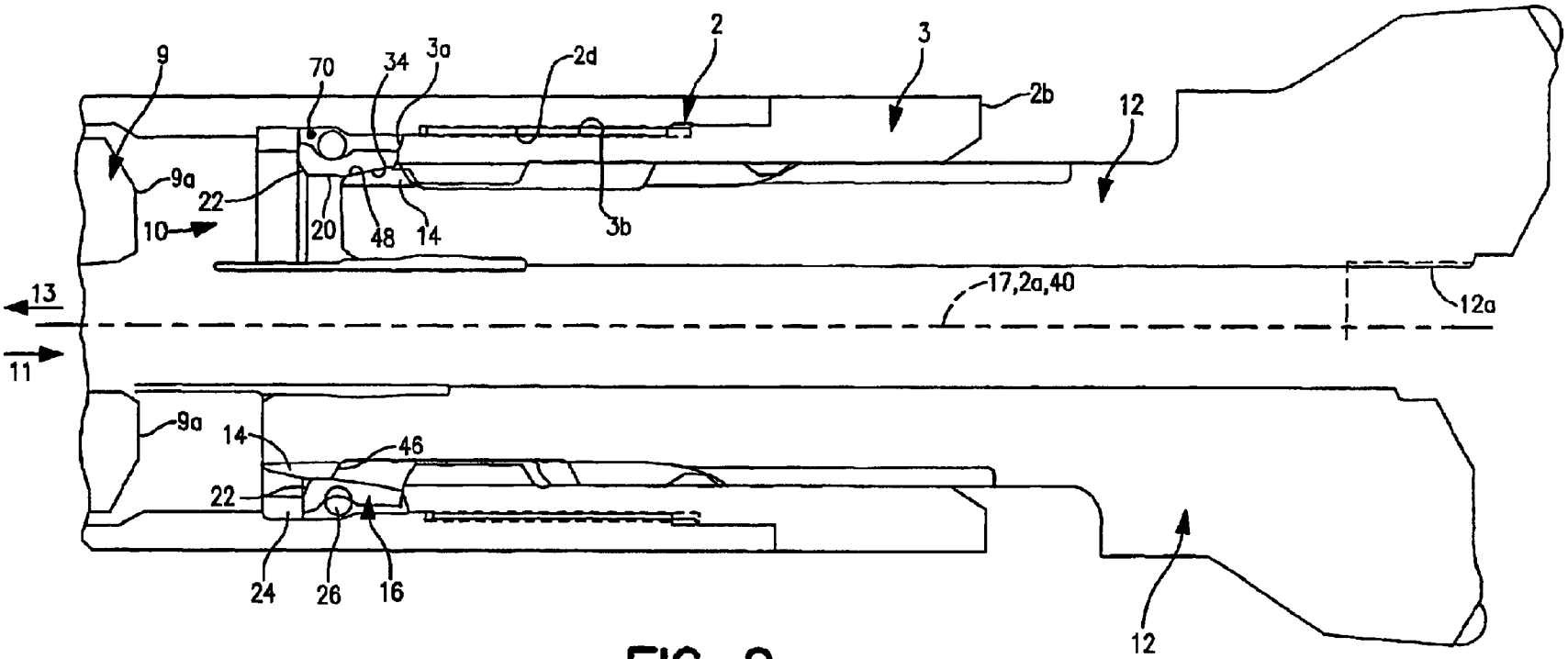
FIG. 8 is a side cross-sectional view of the drill assembly, depicting the drill bit being inserted into the retainer device in the upper half of the drawing figure and the bit causing the retainer device to deflect outwardly in the lower half of the drawing figure.

Referring to FIGS. 4, 8 and 9, with the above-described structure of the retainer device 10 and the bit 12, the retainer device 10, the bit 12, and the chuck 3 are installed into the drill assembly 1 in the following manner. The retainer device 10 is first installed into the casing 2 by seating the spacer 24 into the recess 70 of the drill casing 2. Then, the retainer body 16, with the centralizer 26 disposed thereon, is inserted through the lower end 2*b* of the drill casing 2 and placed against spacer 24 such that the inner axial end 31A (FIG. 4) of the body 16 is disposed against the outer axial end 54B of the spacer 24 and the centralizer 26 is disposed within the recess 70.

Next, the chuck 3 is installed on the drill 1 by threading an externally threaded portion 3*b* of the chuck 3 into an internally threaded section 2*d* of the casing 2 (see, e.g., FIG. 8). When the chuck 3 is completely threaded into the casing 2, the retainer device 10 is essentially "sandwiched" between the inner radial surface 74A of the casing recess 70 and the upper end 3*a* of the chuck 3, as best shown in FIG. 4, thereby preventing any substantial axial movement of the retainer device 10.

Thereafter, as best shown in the upper half of FIG. 8, the bit 12 is installed into the drill 1 by pushing the bit 12 into the lower end 2*b* of the drill casing 2 and along the casing axis 2*a* in a first, inward direction 11 until the bit head 14 enters the retainer body 16. The insertion surface 48 of the bit head 14 contacts and then slides against the lead-in surface 34 of the retainer body 16 such that, with a sufficient axial force applied to the bit 12 as discussed above, the body 16 deflects radially outwardly and allows the bit head 14 to travel axially therethrough, as shown in the lower half of FIG. 8. Once the bit head 14 passes completely along the axial length of the shoulder 18, the retainer body 16 "snaps back" to its undeflected state so that the shoulder stop surface 34 is located to limit axial movement of the bit 12 in the first axial direction 11, as shown in the lower half of FIG. 7.

Once installed, the bit 12 is able to slidably reciprocate within the chuck 3 such that the bit head 14 travels between the lower end 9*a* of the piston 9 (upper half of FIG. 9) and the stop surface 22 (lower half of FIG. 9). As discussed above, under normal operating conditions, the piston 9 does not impact the bit 12 with sufficient force to cause the release surface 46 to "wedge open" the shoulder 18 when the bit 12 contacts the retainer 16. Thus, the stop surface 22 generally prevents further axial movement of the bit 12 in the first or outward direction 11.

When it is desired to remove or extract the bit 12 from the drill casing 2 (e.g., to replace a worn bit 12), the bit 12 is pulled in the outward axial direction 11 with sufficient force to enable the bit head release surface 23 to wedge open the shoulder 18, allowing the bit head 14 to move axially through the retainer body 16. Preferably, a hydraulic puller device (not shown) is threadably engaged with an internally threaded portion 12*a* (FIG. 8) of the bit 12 and is used to exert an axially-directed force on the bit 12 to draw the head 14 through the retainer device 10. Once the bit head 14 passes completely through the retainer body 16, the body 16 snaps or radially deflects back to its undeflected state and the bit 12 is merely slided in the outward direction 13 until the bit 12 is totally withdrawn from the drill casing 2. A new bit 12 may then be inserted in the same manner as described above.

As discussed in detail above, the axial force required to extract the bit 12 from the retainer device 10 is much greater than the force required to insert the bit 12 within the device 10, specifically about 9.8 times greater with the preferred retainer 10 and bit head 14 as depicted in the drawings. By requiring a significantly greater force to extract the bit 12, the retainer device 10 prevents the bit 12 from being ejected from the casing 2 during normal operation/use of the drill assembly 1 (i.e., by impacts from the piston 9), yet the device 10 permits the bit 12 to be installed using only a relatively minimal amount of force.

In any case, the process of installing and removing the drill bits 12 is greatly facilitated by providing the drill assembly 1 with the retainer device 10 of the present invention. Once the retainer device 10 is installed within the casing 2, the bit 12 is ordinarily the only component of the drill assembly 1 that is thereafter removed from and installed into the drill assembly 1 whenever a worn bit 12 is replaced. The process of installing the bit 12 and the process of extracting the bit 12 are each essentially a one-step procedure, i.e. pushing or pulling the bit head 14 through the retainer device 10.

Further, unlike the process described in the Background section for installing and removing bit(s) 12 from a drill 1 having previously known retainer devices 7, the chuck 3 and the retainer device 10 do not have to be removed and re-installed in order to replace a bit 12. As such, all of the several drill bits 12 of a cluster drill 5 can be replaced (i.e., removed and re-installed) while the several individual drills 1 remain in the casing 6. Thus, a substantial amount of time is saved by eliminating the need to remove all the drills 1 from a cluster casing 6 and the chuck 3 and the retainer device 10 from each individual drill assembly 1.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A device for retaining a drill bit connected with a casing of a percussive drill assembly, the casing having a central axis and the bit having a generally cylindrical head, the retainer device comprising:

a generally annular body having a central axis and an inner circumferential shoulder portion projecting generally toward the axis, the body being disposeable within the casing such that the body axis is substantially collinear with the casing axis, the shoulder being deflectable between a first position where the shoulder is contactable with the bit head to retain the bit disposed at least partially within the retainer body and a second position spaced radially outwardly from the first position such that the bit head is displaceable through the body in a direction generally along the casing axis when the body is disposed within the casing.

2. The retainer device as recited in claim 1 wherein:

the bit head has an outer circumferential release surface extending generally radially so as to face generally away from the casing axis and generally toward a first direction along the casing axis; and the retainer shoulder has an inner circumferential stop surface extending generally radially so as to face generally toward the body axis and generally away from the first axial direction, the shoulder being configured such that the stop surface is contactable with the release surface to limit displacement of the bit in the first axial direction during operation of the drill assembly and such that when an extraction force of at least a first magnitude directed generally in the first axial direction is applied to the bit, the release surface is slidable against the stop surface to deflect the shoulder radially outwardly toward the second shoulder position as the bit head displaces through the retainer body in the first axial direction.

3. The retainer device as recited in claim 2 wherein:

the bit head has an outer circumferential insertion surface extending generally radially so as to face generally away from the casing axis and generally toward a second, opposing direction along the casing axis; and the retainer shoulder has an inner circumferential lead-in surface extending generally radially so as to face generally toward the body axis and generally away from the second axial direction, the shoulder being configured such that when an insertion force of at least a second magnitude directed generally in the second axial direction is applied to the bit, the insertion surface is slidable against the lead-in surface to deflect the shoulder radially outwardly toward the second shoulder position as the bit head displaces through the retainer body in the second axial direction.

4. The retainer as recited in claim 3 wherein:

the shoulder stop surface defines a first acute angle with respect to the body axis and the head release surface defines a second acute angle with respect to the casing axis, the first and second angles being substantially equal and having a first angular value; and the shoulder lead-in surface defines a third acute angle with respect to the body axis and the head insertion surface defines a fourth acute angle with respect to the casing axis, the third and fourth angles being substantially equal and having a second angular value, the first angular value being greater than the second angular value such that the extraction force first magnitude is greater than the insertion force second magnitude.

5. The retainer device as recited in claim 1 wherein:

the drill casing has an inner circumferential surface and an annular recess extending circumferentially into the casing from the inner surface;

the retainer body has an outer circumferential surface circumscribing the body axis; and the retainer device further comprises a generally annular centralizer disposed about the body outer surface and disposeable at least partially within the casing recess, the centralizer being configured to generally center the retainer body within the casing such that the body axis is substantially collinear with the casing axis.

6. The retainer device as recited in claim 5 wherein:

the drill assembly further includes a drill chuck disposed within the casing and having an axial end;

the drill casing recess further has an inner circumferential surface and a radial surface;

the retainer body has first and second opposing axial ends, the second end being disposeable against the chuck radial end; and the retainer device further comprises a generally annular spacer having an outer circumferential surface and two opposing axial ends, the spacer member being configured such that the spacer outer surface is disposeable against the recess inner surface, one of spacer axial ends is disposeable against the recess radial surface and the other one of the spacer axial ends is disposeable against the body first axial end so that the retainer body is generally retained at a desired position within the casing.

7. The retainer device as recited in claim 1 wherein:

the drill assembly further includes a drill chuck disposed within the casing and having an axial end;

the drill casing has an inner circumferential surface and an annular recess extending circumferentially into the casing from the inner surface, the recess having an inner circumferential surface and a radial surface;

the retainer body has opposing axial ends and further includes a spacer portion with an outer circumferential surface, the spacer portion being configured such that the spacer outer surface is disposeable against the recess inner surface so that the retainer body is generally centered within the casing with the body axis being substantially collinear with the casing axis, one of the two body axial ends being disposeable against the recess radial surface and the other one of the two body axial ends being disposeable against the chuck radial end such that the body is generally retained at a desired position within the casing.

8. The retainer device as recited in claim 1 wherein the retainer body is formed of one of an elastic material and an elastomeric material such that material forces generated within the body when the shoulder is deflected bias the shoulder generally toward the first shoulder position.

9. A drill assembly comprising:

a casing having a hollow interior and a central axis;

a drill bit having a generally cylindrical head; and a generally annular retainer disposed within the casing interior and having an inner circumferential shoulder projecting generally toward the casing axis, the shoulder being deflectable between a first position where the shoulder is contactable with the bit head to retain the bit disposed at least partially within the retainer and a second position spaced radially outwardly from the first position such that the bit head is displaceable through the retainer in a direction generally along the casing axis when the retainer is disposed within the casing.

10. The drill assembly as recited in claim 9 wherein:

the bit head has an outer circumferential release surface extending generally radially so as to face generally away from the casing axis and generally toward a first direction along the axis; and the retainer shoulder has an inner circumferential stop surface extending generally radially so as to face generally toward the casing axis and generally away from the first axial direction, the shoulder being configured such that the stop surface is contactable with the release surface to limit displacement of the bit in the first axial direction during operation of the drill and such that when an extraction force of at least a first magnitude directed generally in the first axial direction is applied to the bit, the release surface is slidable against the stop surface to deflect the shoulder radially outwardly toward the second shoulder position as the bit head displaces through the retainer in the first axial direction.

11. The drill assembly as recited in claim 10 wherein:

the bit head has an outer circumferential insertion surface extending generally radially so as to face generally away from the casing axis and generally toward a second, opposing direction along the axis; and the retainer shoulder has an inner circumferential lead-in surface extending generally radially so as to face generally toward the casing axis and generally away from the second axial direction, the shoulder being configured such that when an insertion force of at least a second magnitude directed generally in the second axial direction is applied to the bit, the insertion surface is slidable against the lead-in surface to deflect the shoulder radially outwardly toward the second shoulder position as the bit head displaces through the retainer body in the second axial direction.

12. The drill assembly as recited in claim 11 wherein:

the shoulder stop surface defines a first acute angle with respect to the casing axis and the head release surface defines a second acute angle with respect to the axis, the first and second angles being substantially equal and having a first angular value; and the shoulder lead-in surface defines a third acute angle with respect to the casing axis and the head insertion surface defines a fourth acute angle with respect to the casing axis, the third and fourth angles being substantially equal and having a second angular value, the first angular value being greater than the second angular value such that the extraction force first magnitude is greater than the insertion force second magnitude.

13. The drill assembly as recited in claim 9 wherein:

the casing has an inner circumferential surface and an annular recess extending circumferentially into the casing from the inner surface;

the retainer has an outer circumferential surface circumscribing the casing axis; and the drill assembly further comprises a generally annular centralizer disposed about the retainer outer surface and disposed at least partially within the casing recess, the centralizer being configured to generally center the retainer about the casing axis.

14. The drill assembly as recited in claim 13 wherein:

the casing recess has an inner circumferential surface and two opposing radial surfaces;

the retainer has two opposing axial ends; and the drill assembly further comprises a generally annular spacer having an outer circumferential surface and two opposing axial ends, the spacer outer surface being disposed against the recess inner surface, one of spacer axial ends being disposed against one of the two recess radial surfaces and the other one of the spacer axial ends being disposed against a proximal one of the two retainer axial ends, such that the retainer is generally retained within the casing at a desired position along the casing axis.

15. The drill assembly as recited in claim 9 wherein:

the casing has an inner circumferential surface and an annular recess extending circumferentially into the casing from the inner surface, the recess having an inner circumferential surface and two opposing radial surfaces;

the retainer further includes a spacer portion with an outer circumferential surface and two opposing axial ends, the spacer portion being configured such that the spacer outer surface is disposed against the recess inner surface and each one of the two spacer axial ends is disposed against a separate, proximal one of the two recess radial surfaces, such that the retainer is generally centered about the casing axis and is generally retained at a desired position within the casing.

16. The drill assembly as recited in claim 9 wherein the retainer is formed of one of an elastic material and an elastomeric material such that material forces generated within the retainer when the shoulder is deflected bias the shoulder generally toward the first shoulder position.

17. A device for retaining a drill bit within a casing of a percussive drill, the casing having a central axis and the bit having a head, the retainer device comprising:

a generally annular body having a central axis and an inner circumferential shoulder extending generally toward the central axis, the body being disposeable within the casing such that the body axis is substantially collinear with the casing axis, the shoulder being contactable with the bit so as to retain the bit disposed at least partially within the casing and deflectable in a generally radially-outward direction with respect to the body axis so as to permit the bit to displace through the body in a direction generally along the casing axis when the body is disposed within the casing.

18. The retainer device as recited in claim 17 wherein the shoulder is deflectable between a first, radially inward position where the shoulder is contactable with the bit head and a second, radially outward position where the bit head is slidable against an inner surface of the shoulder.

19. The retainer device as recited in claim 17 wherein the retainer body is formed of one of an elastic material and an elastomeric material such that material forces generated within the body when the shoulder is deflected bias the shoulder generally toward the first shoulder position.

* * * * *